United States Patent [19]

Mushardt

[11] Patent Number: 4,813,187

[45] Date of Patent: Mar. 21, 1989

[54] METHOD OF GRINDING ARCUATE SURFACES OF WORKPIECES

[75] Inventor: Heinrich Mushardt, Neu-Börnsen, Fed. Rep. of Germany

[73] Assignee: Körber AG, Hamburg, Fed. Rep. of Germany

[21] Appl. No.: 74,925

[22] Filed: Jul. 17, 1987

[30] Foreign Application Priority Data

Jul. 29, 1986 [DE] Fed. Rep. of Germany ..... 3625565

[51] Int. Cl.[4] ..... B24B 1/00

[52] U.S. Cl. ..... 51/281 R; 51/38

[58] Field of Search ..... 51/281 R, 284, 288, 51/105 L, 124 L, 165.77, 5 D, 34 R, 38, 48 R, 50 R, 74 R

[56] References Cited

U.S. PATENT DOCUMENTS

| | | | |
|---|---|---|---|
| 3,142,140 | 7/1964 | Ishida | 51/284 |
| 3,492,764 | 2/1970 | Dalton | 51/284 |
| 3,824,742 | 7/1974 | Rupp | 51/284 |

FOREIGN PATENT DOCUMENTS

| | | | |
|---|---|---|---|
| 0200410 | 5/1983 | Fed. Rep. of Germany | 51/284 R |

*Primary Examiner*—Frederick R. Schmidt
*Assistant Examiner*—Robert Rose
*Attorney, Agent, or Firm*—Peter K. Kontler

[57] ABSTRACT

A method of grinding an arcuate (concave or convex) surface of a workpiece in a grinding machine involves rotation of the workpiece about an axis which may but need not intersect the workpiece and which need not include the center of curvature of the arcuate surface. The locus of material-removing contact between the working surface of the griding wheel and the arcuate surface of the workpiece is maintained on a straight line which connects the center of the grinding wheel with the center of curvature of the arcuate surface. The grinding wheel and the workpiece further perform translatory movements in directions at right angles to each other. If the arcuate surface is inclined with reference to such directions, the workpiece or the grinding wheel is moved in a third direction transversely of the directions of translatory movement of the workpiece and the grinding wheel.

8 Claims, 3 Drawing Sheets

METHOD OF GRINDING ARCUATE SURFACES OF WORKPIECES

BACKGROUND OF THE INVENTION

The invention relates to improvements in methods of grinding arcuate surfaces, and more particularly to improvements in methods of grinding arcuate surfaces in form grinders or surface grinding machines of the type wherein the workpiece and the material removing tool can perform angular and translatory movements. Still more particularly, the invention relates to improvements in methods which involve translatory movements of the workpiece and of the grinding tool in directions which are selected as a function of the curvature of the surface to be treated.

In accordance with heretofore known methods, an arcuate surface of a workpiece is treated by a grinding wheel while the workpiece rotates or orbits about an axis which includes the center of curvature of the surface that requires treatment. This is considered desirable and advantageous because the workpiece must only perform pure angular movements but no translatory movements with reference to the grinding tool. A drawback of such method is that, if the radius of curvature of the surface to be treated is large or very large, the workpiece must be mounted on a large or very large rotary support, e.g., on a turntable whose axis intersects the center of curvature of the arcuate surface. Alternatively, it is necessary to provide a complex system of levers and/or links to move the workpiece during removal of material from its arcuate surface.

In accordance with another prior proposal, arcuate surfaces of workpieces are treated in a grinding machine by causing the workpiece to perform a first translatory movement and by causing the grinding wheel to rotate and perform a different second translatory movement. For example, the workpiece can be moved in parallelism with the supporting surface of its table and tangentially of the rotating grinding tool, and the grinding tool is then caused to move at right angles to the direction of translatory movement of the workpiece. This results in the treatment of an arcuate surface on the workpiece. Such prior proposal exhibits the drawback that the point where the grinding wheel applies a grinding force to the workpiece and the direction of action of the force do not remain constant.

OBJECTS AND SUMMARY OF THE INVENTION

An object of the invention is to provide a novel and improved method of treating arcuate surfaces in surface grinding machines or form grinders in such a way that the surface which requires treatment is subjected to the action of relatively small forces and the quality of surface finish is more satisfactory than that of the surface finish which can be obtained in accordance with heretofore known methods.

Another object of the invention is to provide a method which can be practiced to simultaneously treat several surfaces of a workpiece and which renders it possible to treat large or small arcuate surfaces with the same degree of precision.

A further object of the invention is to provide a machine for the practice of the above outlined method.

The improved method involves manipulation of a rotary grinding tool and a workpiece which has an arcuate surface with a predetermined center of curvature and which is to be treated by the grinding tool in such a way that the latter removes material from the arcuate surface. The method comprises the steps of rotating the workpiece about a predetermined axis which does not include the center of curvature of the arcuate surface, maintaining the grinding tool (e.g., a wheel) in material-removing contact with the arcuate surface of the workpiece, and maintaining the region of material removing contact between the tool and the arcuate surface on a straight line which connects the center of the tool with the center of curvature of the arcuate surface. The predetermined axis may but need not intersect the workpiece.

The method can further comprise the steps of moving the workpiece and the tool relative to each other in first and second directions as well as in a third direction transversely of the first and second directions. The first and second directions can make an angle of 90 degrees, and the third direction can make an angle of 90 degrees with the first as well as with the second direction. Alternatively, at least two of the three directions can make an oblique angle.

The novel features which are considered as characteristic of the invention are set forth in particular in the appended claims. The improved method itself, however, together with additional features and advantages thereof, will be best understood upon perusal of the following detailed description of certain specific embodiments with reference to the accompanying drawing.

DESCRIPTION OF THE PREFERRED EMBODIMENTS

Figure 1:
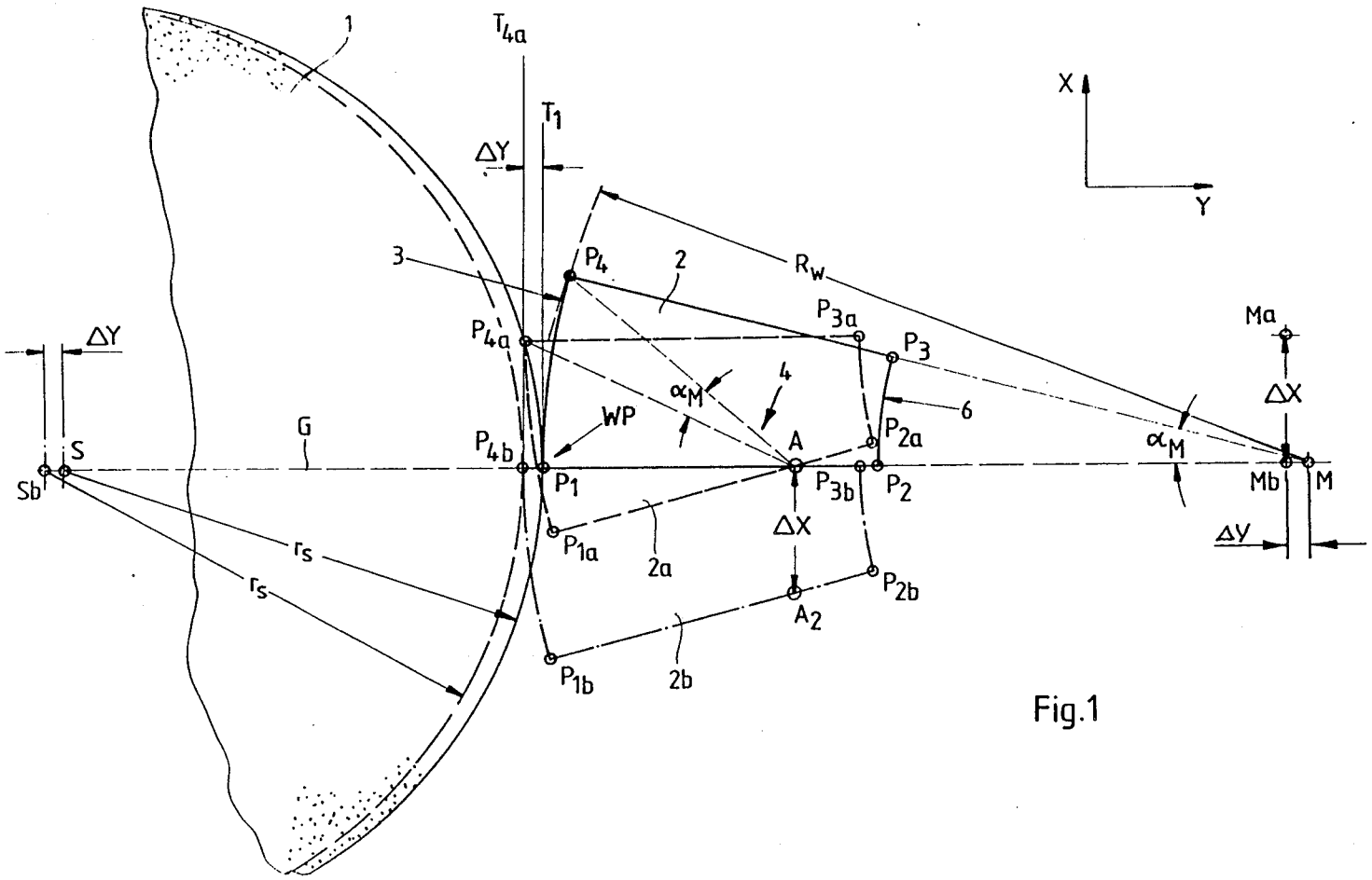
FIG. 1 is a schematic representation of a portion of a grinding wheel and of a workpiece during treatment of the workpiece in accordance with the method of the present invention.

Referring first to FIG. 1, there is shown a portion of a rotary grinding tool 1 in the form of a wheel whose center S is located on the axis of rotation of the wheel and whose working surface (peripheral surface) is to remove material from an arcuate (convex) surface 3 of a workpiece 2 which is rotatable about an axis A. The grinding wheel 1 is rotatable about its axis and is further mounted on a carriage or slide (not shown in FIG. 1) for translatory linear movement in the direction of the axis Y, i.e., at right angles to its axis of rotation. The reference characters $r_s$ denote the radii of the grinding wheel 1.

The workpiece 2 is shown in three different positions, namely in the solid-line position, in a second position 2*a* which is indicated by broken lines, and a third position 2*b* which is indicated by phantom lines. The center of curvature of the arcuate surface 3 of the workpiece 2 is shown at M, and this surface has a radius of curvature $R_w$. The workpiece 2 has a second arcuate (concave) surface 6 opposite the arcuate surface 3, and the workpiece is mounted in or on a carriage or slide (not shown in FIG. 1) which is arranged to perform linear translatory movements in the direction of the X-axis, i.e., at right angles to the direction (Y) of translatory movement of the carriage or slide for the grinding wheel 1. Still further, the workpiece 2 is rotatable about the aforementioned axis A which intersects the workpiece and is parallel to the axis of rotation of the grinding wheel 1. The means for rotating the workpiece 2 about the axis A can comprise a turntable or the like, not shown in FIG. 1. The points at the four corners of the projection of the workpiece 2 into a plane which extends at right angles to the axis A and to the axis of the grinding wheel 1 are respectively shown at $P_1$, $P_2$, $P_3$ and $P_4$.

When the grinding operation is in progress, i.e., when the working surface of the grinding wheel 1 is to treat the arcuate surface 3 of the workpiece 2 (the surface 3 is or can form part of a cylindrical surface or a surface having a circular outline with the center at M), the workpiece 2 rotates about the axis A, the grinding wheel 1 rotates about the axis which passes through its center S and is parallel to the axis A, the grinding wheel is moved in the direction of the arrow Y, and the workpiece is moved in the direction of the arrow X.

In accordance with heretofore known methods, the workpiece is rotated about an axis which includes the center M of curvature of the surface 3 to be ground, i.e., the workpiece 3 must orbit about an axis which includes the center of curvature of the surface 3. This necessitates the utilization of a relatively large turntable so that the workpiece can be adequately supported while orbiting along a path which is remote from the axis of rotation. In accordance with the present invention, grinding of the arcuate surface 3 takes place while the workpiece rotates about an axis (A) which does not coincide with the center of curvature M. In the embodiment of FIG. 1, the axis A intersects or at least contacts the workpiece 3 so that the workpiece actually rotates instead of orbiting. However, it is equally within the purview of the invention to cause the workpiece 2 to perform an angular movement about an axis which does not intersect any part of the workpiece and is spaced apart from the center of curvature M (note FIGS. 2 and 3).

The solid lines show the position of the workpiece 2 when the treatment of the arcuate surface 3 begins. The workpiece 2 is or can constitute a portion of a ring with the aforementioned arcuate surfaces 3, 6 and two additional surfaces (between the points $P_1$, $P_2$ and $P_3$, $P_4$, respectively) which are located in planes including the center of curvature M. At the onset of the material removing operation, the points $P_1$ and $P_2$ are located on a straight line G which connects the center of curvature M of the surface 3 with the center S of the grinding wheel 1. The location of contact between the surface 3 and the working surface of the grinding wheel 1 is shown at WP, and the reference character $T_1$ denotes a line which is tangential to the surface 3 as well as to the working surface of the grinding wheel 1 at the location WP. The location WP coincides with the point $P_1$.

As mentioned above, the workpiece 2 is mounted on a turntable which is caused to rotate about the axis A. If the turntable is rotated through an angle $\alpha_M$ in the direction of arrow 4, the point $P_1$ is moved to $P_{1a}$, the point $P_2$ is moved to the location $P_{2a}$, the point $P_3$ is moved to the location $P_{3a}$, and the point $P_4$ is moved to the location $P_{4a}$. The position of the tangent $T_1$ is changed to $T_{4a}$, i.e., the inclination of the tangent does not change but such tangent is shifted by a distance $\Delta Y$. The workpiece 2 must be shifted radially of the grinding wheel 1 through the same distance, namely $\Delta Y$. Alternatively, it is necessary to shift the grinding wheel 1 radially through the distance $\Delta Y$ so that the center S is moved to Sb. If the workpiece 2 is shifted radially of the grinding wheel 1 while it turns about the axis A, the locations $P_{1a}$, $P_{2a}$, $P_{3a}$, $P_{4a}$ of the respective corner points $P_1$, $P_2$, $P_3$, $P_4$ are respectively shifted to the locations $P_{1b}$, $P_{2b}$, $P_{3b}$, $P_{4b}$, i.e., the workpiece 2 has been moved from the position 2*a* to the end position 2*b*. The center of curvature M is moved to Mb. The points $P_3$ and $P_4$ (in the respective positions $P_{3b}$ and $P_{4b}$) are then located on the straight line G which connects the center S of the grinding wheel 1 with the center of curvature M of the surface 3. At such time, the working surface of the grinding wheel 1 contacts the surface 3 at the point $P_4$ (which is then located at $P_{4b}$). The axis A has been shifted through the distance $\Delta X$ to $A_2$ and the center of curvature M has been shifted to Ma, again through the distance $\Delta X$.

It will be appreciated that various movements of the workpiece 2 and grinding wheel 1 are greatly exaggerated in FIG. 1 for the sake of clarity. In actual practice, the treatment of the arcuate surface 3 is carried out in a large number of small or extremely small stages or steps each of which involves a movement of the rotating grinding wheel 1 in the direction of the Y-axis, a movement of the workpiece 2 in the direction of the X-axis, and an angular movement of the workpiece 2 about the axis A. At the same time, the location of contact WP between the working surface of the grinding wheel 1 and the surface 3 of the workpiece 2 remains on the straight line G which connects the center S of the grinding wheel with the center of curvature M of the surface 3, i.e., of that arcuate surface which is in the process of being treated by the grinding wheel. The various translatory and angular movements can be carried out in any desired sequence. Alternatively, two or all three movements can coincide so as to ensure that the grinding wheel 1 moves practically continuously in the direction of the arrow Y, the workpiece 2 moves practically continuously in the direction of the arrow X, and the workpiece 2 rotates practically continuously about the axis A. It is further clear that the workpiece 2 and the grinding wheel 1 need not necessarily move in the directions of the axes X and Y but can also perform translatory movements in other directions without departing from the spirit of the invention.

The arcuate (concave) surface 6 of the workpiece 2 can be treated by a rotary grinding wheel which is located to the right of the points $P_2$ and $P_3$, as seen in FIG. 1, and is movable in the direction of the arrow Y in the same way as the grinding wheel 1. Moreover, and if the center of curvature of the concave surface 6 coincides with the center of curvature M of the convex surface 3, the two arcuate surfaces can be ground simultaneously. The curvature of the surface (such as 3 or 6) to be treated is independent of the radius ($r_s$) of the grinding wheel 1.

Figure 2:
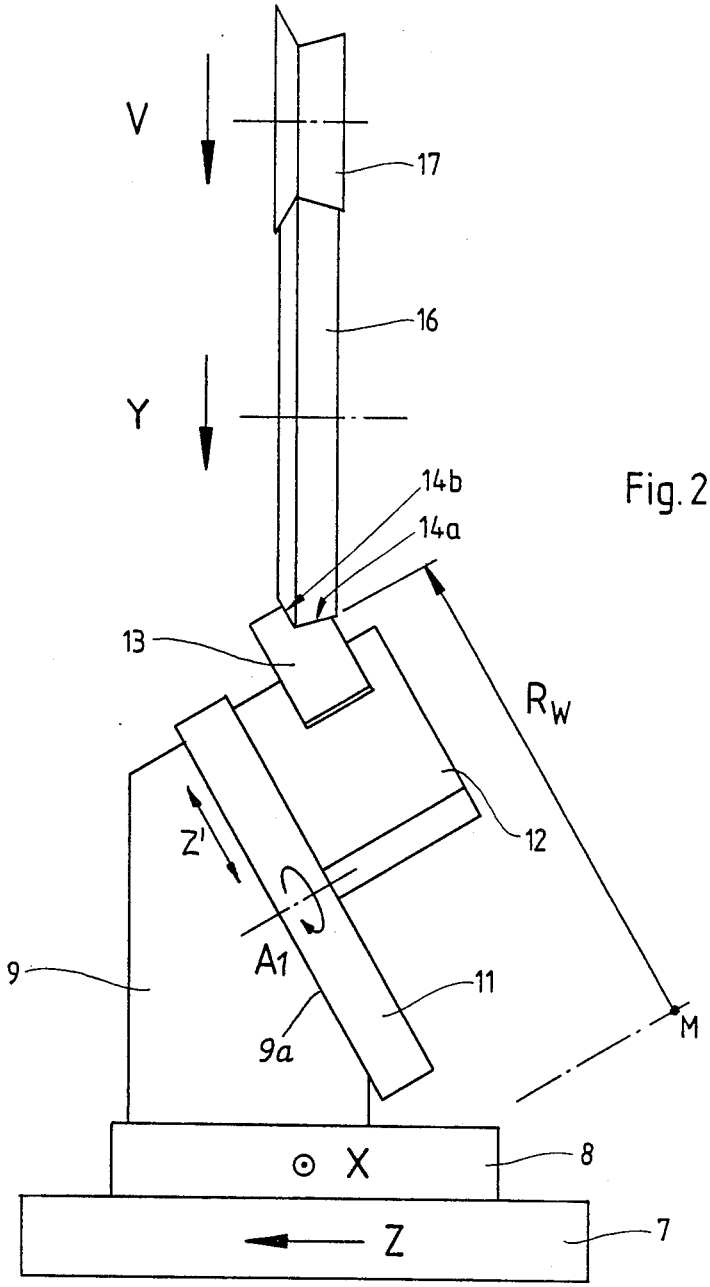
FIG. 2 is an elevational view of certain component parts of a grinding machine which can be utilized for the practice of a somewhat modified method.
Figure 3:
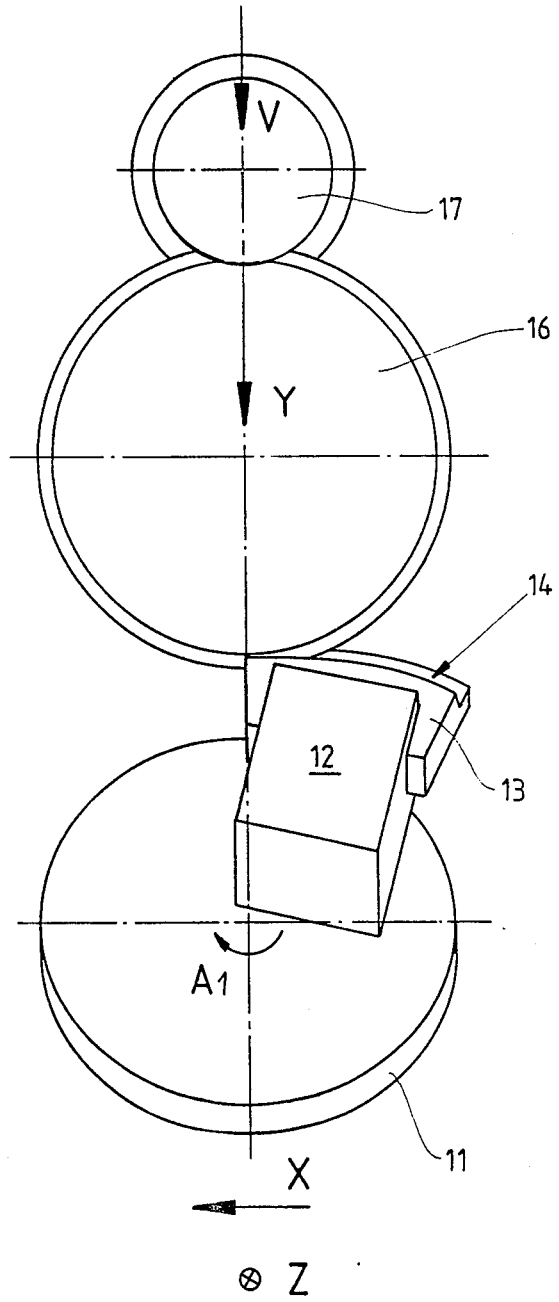
FIG. 3 is a front elevational view of a portion of the structure which is shown in FIG. 2.

FIGS. 2 and 3 show certain component parts of a grinding machine which can be used for the practice of a modified method. The machine comprises a table or bed 7 which is movable in the direction indicated by arrow Z, and the table 7 supports a work slide or carriage 8 which is reciprocable at right angles to the plane of FIG. 2 (note the arrow X in FIG. 3). The carriage 8 supports a carrier 9 in the form of a column having an inclined face 9*a* supporting a turntable 11 which is rotatable about an axis A1 extending at right angles to the plane of the surface 9*a*. The turntable 11 supports a work holder 12 for a workpiece 13 having an arcuate surface 14 including two mutually inclined portions or sections 14a, 14b. The radius of curvature of the arcuate surface 14 is shown at $R_w$, and the center of curvature of the surface 14 is shown at M.

The grinding wheel 16 has a profile which is complementary to that of the arcuate surface 14 and the grinding wheel is rotatable about its own axis while being simultaneously movable in the direction of arrow Y. The reference character 17 denotes a rotary dressing tool which can treat the working surface of the grinding wheel 16 while the latter removes material from the arcuate surface 14 of the workpiece 13; to this end, the dressing tool 17 is movable in the direction of arrow V and is also rotatable about its own axis which extends at right angles to the direction of arrows Y and V and is parallel to the axis of the grinding wheel 16.

The mounting of the workpiece 13 on the turntable 11 and work holder 12 is such that the arcuate surface 14 extends in three dimensions (spatially) with reference to the grinding wheel 16. In accordance with the embodiment of the method which is carried out in the machine of FIGS. 2 and 3, the workpiece 13 and/or the grinding wheel 16 performs a third linear translatory movement (in the direction of the axis Z) at right angles to the directions which are indicated by the arrows X and Y. In the illustrated machine, the movements in the direction of the Z-axis are performed by the workpiece 13 with the base or table 7 which supports the carriage 8 and hence also the carrier 9, turntable 11 and work holder 12. It will be noted that the workpiece 13 is arranged to perform an angular movement about an axis A1 which does not intersect any part of the workpiece; nevertheless, the diameter of the turntable 11 is a small fraction of the diameter of a turntable which would have to rotate about an axis including the center of curvature M and would have to support the workpiece 13 in the position of FIG. 2. The position of the axis A1 with reference to the workpiece 13 is analogous to the position of an axis of rotation for the workpiece 2 of FIG. 1 at a location close to and to the right of the point $P_2$.

The dressing tool 17 must be mounted for movement in the direction of arrow V only if the working surface of the grinding wheel 16 is to be dressed continuously while such working surface removes material from the arcuate surface 14 of the workpiece 13 so that the tool 17 can compensate for continuous reduction of the diameter of the grinding wheel.

An advantage of the method which can be carried out with the machine of FIGS. 2 and 3 is that the movement in the direction of the axis X or Y need not be reversed because the workpiece 13 rotates about an axis A1 which does not intersect any part of the workpiece.

FIG. 2 further shows that the movement of the workpiece 13 in the direction of the arrow Z or the translatory movement of the grinding wheel 16 in the direction of the arrow Y can be replaced with a movement of the workpiece or grinding wheel in the directions of double-headed arrow Z', namely at right angles to the axis A1 and in parallelism with the inclined surface 11a of the table 11.

Translatory movement in the third direction Z at right angles to the directions which are indicated by the arrows X and Y is necessary in order to compensate for the fact that the arcuate surface 14 of the workpiece 13 is not located in a plane which is parallel to the plane of the axis X or Y. The movement which is performed by the table 7 in the direction of the arrow Z ensures that the workpiece 13 does not move away from the working surface of the grinding wheel 16 in the course of the material removing operation.

An advantage of the improved method is that it is possible to grind arcuate surfaces with large radii of curvature in relatively small machines, i.e., in machines wherein the workpiece need not rotate about the center of curvature of its arcuate surface.

Another advantage of the improved method is that the location WP of contact between the working surface of the grinding wheel and the arcuate surface 3, 6 or 14 of the workpiece which is being treated invariably remains in the same angular position. This ensures that the direction of action of the grinding force remains unchanged so that the stress upon the workpiece in the course of the entire grinding operation remains constant. This, in turn, ensures that the quality of finish of the treated arcuate surface is much more uniform than if the surface were treated in accordance with aforediscussed conventional methods.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of manipulating a rotary grinding tool having a peripheral surface with a working profile and a workpiece which has an arcuate surface with a predetermined center line of curvature and which is to be treated by the grinding tool in that the grinding tool removes material from the arcuate surface, comprising the steps of imparting to the workpiece an angular movement about a predetermined axis; maintaining the peripheral surface of the rotary tool in material-removing contact with the arcuate surface of the workpiece; maintaining the point of contact between the tool and the arcuate surface on a line which connects the center line of the tool with the center line of curvature of the workpiece; and moving the workpiece and the tool relative to each other in first and second directions which are inclined relative to each other.

2. The method of claim 1, wherein said line is a straight line.

3. The method of claim 1, wherein said predetermined axis is spaced apart from the center line of curvature of the workpiece.

4. The method of claim 1, wherein said predetermined axis intersects the workpiece.

5. The method of claim 1, wherein said predetermined axis bypasses the workpiece.

6. The method of claim 1, further comprising the steps of moving the workpiece and the tool relative to each other in a third direction transversely of said first and second directions.

7. The method of claim 6, wherein the first and second directions make an angle of 90 degrees.

8. The method of claim 6, wherein at least two of said directions make an oblique angle.

* * * * *

Disclaimer 4,813,187—Heinrich Mushardt, Neu-Bornsen, Fed. Rep. of Germany. METHODS OF GRINDING ARCUATE SURFACES OF WORKPIECES. Patent dated March 21, 1989. Disclaimer filed July 14, 1997, by the assignee, Korber AG.

Hereby enters this disclaimer to claims 1-5 of said patent.

*(Official Gazette,* November 4, 1997)